US009109307B2

(12) United States Patent
Brenk et al.

(10) Patent No.: US 9,109,307 B2
(45) Date of Patent: Aug. 18, 2015

(54) YARN TREATMENT CHAMBER

(75) Inventors: Siegfried Brenk, Deutschland (DE); Jan-Markus Rottgering, Wegberg (DE); Jurgen Schnitzler, Viersen (DE); Georg Tetzlaff, Aachen (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 539 days.

(21) Appl. No.: 13/554,310

(22) Filed: Jul. 20, 2012

(65) Prior Publication Data

US 2013/0186152 A1 Jul. 25, 2013

(30) Foreign Application Priority Data

Jul. 20, 2011 (DE) ..... 10 2011 108 112

(51) Int. Cl.

| | |
|---|---|
| ***D02J 13/00*** | (2006.01) |
| ***D06B 3/06*** | (2006.01) |
| ***D06B 3/04*** | (2006.01) |
| ***D06B 23/18*** | (2006.01) |

(52) U.S. Cl.

CPC ..... *D02J 13/001* (2013.01); *D06B 3/04* (2013.01); *D06B 3/045* (2013.01); *D06B 23/18* (2013.01)

(58) Field of Classification Search

CPC ..... D06B 23/18; D06B 3/045; D06B 3/06; D06B 3/04; D02J 13/00; D02J 13/005; D02J 13/006; D02J 13/008

USPC ..... 28/219, 220, 271, 272, 281; 68/5 D, 5 E, 68/5 C; 57/282, 309

See application file for complete search history.

(56) References Cited

U.S. PATENT DOCUMENTS

| | | | | | |
|---|---|---|---|---|---|
| 2,865,112 | A | * | 12/1958 | Annesser | 34/242 |
| 2,974,512 | A | * | 3/1961 | Carter | 68/5 E |
| 3,067,563 | A | * | 12/1962 | Van Dijk | 57/290 |
| 3,241,343 | A | * | 3/1966 | Yazawa | 68/5 E |
| 3,318,114 | A | * | 5/1967 | Schneider | 68/5 D |
| 3,386,143 | A | * | 6/1968 | Van Silfhout | 28/265 |
| 3,445,996 | A | * | 5/1969 | Berger, Jr. | 57/290 |
| 3,651,671 | A | * | 3/1972 | Sando et al. | 68/5 E |
| 3,701,268 | A | * | 10/1972 | Treptow et al. | 68/5 D |
| 3,726,137 | A | * | 4/1973 | Denton | 73/160 |
| 4,055,970 | A | * | 11/1977 | Sando et al. | 68/5 E |
| 4,192,128 | A | | 3/1980 | Vetterli | |

(Continued)

FOREIGN PATENT DOCUMENTS

| | | | |
|---|---|---|---|
| EP | 1348785 | A1 | 10/2003 |
| FR | 1079377 | A * | 11/1954 |

*Primary Examiner* — Amy Vanatta

(74) *Attorney, Agent, or Firm* — Nelson Mullins Riley & Scarborough LLP

(57) ABSTRACT

A yarn treatment chamber for thermal treatment of a running yarn, with a center zone, in which a pressurized hot, gaseous or vaporous medium acts on the yarn, and end zones on both sides of the center zone, in which a cooling, gaseous medium is active. The end zones have a yarn inlet or outlet openings with a yarn sluice, which seals the associated end zone and the yarn treatment chamber. The yarn inlet and outlet openings (2, 3) are arranged such that the yarn (14) must change direction, and the yarn treatment chamber (21 has yarn deflection means (12) to guide the yarn (14) between the yarn inlet and outlet openings (2, 3). Both the yarn sluice (23A) and the yarn sluice (23B) are accessible without problems to operating staff at an ergonomically favorable height below the yarn deflection means (12) of the yarn treatment chamber (21).

14 Claims, 7 Drawing Sheets

(56) References Cited

U.S. PATENT DOCUMENTS

| | | | | |
|---|---|---|---|---|
| 4,198,835 | A * | 4/1980 | Luthi | 68/5 E |
| 4,638,955 | A * | 1/1987 | Schippers et al. | 242/473.8 |
| 6,026,636 | A | 2/2000 | Lorenz et al. | |
| 6,929,134 | B2 | 8/2005 | Fujita | |
| 7,080,501 | B2 | 7/2006 | Pyra | |
| 7,356,984 | B2 * | 4/2008 | Brenk | 57/295 |
| 7,475,573 | B2 | 1/2009 | Brenk | |
| 2004/0098964 | A1 * | 5/2004 | Pyra et al. | 57/284 |
| 2005/0102764 | A1 * | 5/2005 | Brenk | 8/149.3 |
| 2009/0320437 | A1 * | 12/2009 | Brenk | 57/290 |
| 2011/0283748 | A1 | 11/2011 | Brenk et al. | |

* cited by examiner

YARN TREATMENT CHAMBER

CROSS-REFERENCE TO RELATED APPLICATIONS

This application claims the benefit of German patent application 10 2011 108 112.0, filed Jul. 20, 2011, herein incorporated by reference.

BACKGROUND OF THE INVENTION

The invention relates generally to a yarn treatment chamber for the thermal treatment of a running yarn. The invention relates more particularly to a yarn treatment chamber for the thermal treatment of a running yarn, with a centre zone, in which a hot, gaseous or vaporous medium under pressure acts on the yarn, and end zones arranged on both sides of the centre zone, in which a cooling, gaseous medium is active, the end zones each having a yarn inlet opening or a yarn outlet opening with a yarn sluice, which, in the operating state in conjunction with the running yarn, seals the associated end zone and therefore the yarn treatment chamber It is known in the textile industry to subject yarns, in particular after twisting or cabling, to a thermal treatment in a yarn treatment device and to therefore achieve a significant improvement in the yarn quality. A thermal treatment of this type does not only stabilise the state of the yarns after twisting or cabling, but also frees the yarns, in the process, from inner torsional forces. A thermal treatment of this type also often brings about an increase in volume of the yarns by shrink bulking.

Numerous patent applications, in which different yarn treatment devices are described, are known in the patent literature in connection with the thermal treatment of yarns. For example, it is proposed in various patent applications that a so-called yarn treatment chamber, with which a thermal setting can be carried out on the running yarn, is to be arranged in each case in the region of the workstations of twisters.

Yarn treatment chambers of this type, which are described in relative detail, for example, in European Patent Document EP 1 348 785 A1 or German Patent Document DE 103 48 278 A1, generally have a vertically arranged thermal treatment section with yarn inlet or yarn outlet openings opposing one another and arranged at the end.

In other words, the known yarn treatment chambers in each case have a centre zone, into which a hot, gaseous or vaporous treatment medium under pressure is blown, as well as end zones which are arranged on both sides of this centre zone and are acted on, in each case, with a cooling, gaseous medium, for example compressed air. The yarn inlet or yarn outlet opening arranged in the region of the end zones is in each case equipped with a sealing device, which seals the yarn treatment chamber from the environment. Sealing devices of this type are important components of yarn treatment chambers of this type as, on the one hand, efficient sealing has to be ensured by the yarn running through during operation and, on the other hand, the friction of the yarn running through should be as low as possible.

Even if there has been success with the known yarn treatment chambers in making the setting process of yarns relatively economical and efficient, there is still certainly potential for improvement in these yarn treatment chambers, in particular with regard to the arrangement of their yarn inlet opening and the configuration of their sealing devices. In other words, in the known yarn treatment chambers, the treatment section required for proper thermal treatment is relatively long, which, in conjunction with the vertical arrangement of the treatment section, leads to the upper yarn sluice arranged in the region of the yarn inlet opening generally being at a height of 2.5 m to 3.5 m and therefore being difficult for the operating staff to reach. In practice this means that the operating staff, if any work is necessary in the region of the upper yarn sluice, have to use an additional aid, for example a ladder or a comparable stepping assistance.

Consequently, with these yarn treatment chambers, both during maintenance work and also during the threading of a yarn, for example after a thread break or a feed material change, the operating staff always have to work with climbing assistance, which is laborious, time-consuming and not without danger when the textile machine is running.

Even if the known yarn treatment chambers are certainly configured in a comparable manner with regard to their thermal treatment section, these yarn treatment chambers differ, sometimes considerably, in particular with regard to their sealing devices, the so-called yarn sluices, arranged at the yarn inlet or yarn outlet openings.

The yarn treatment chamber described in European Patent Document EP 1 348 785 A1, for example, has sealing devices at the end of its thermal treatment section arranged in a linear orientation, which in each case consist of drivable outer sluice rollers and inner sealing rollers, the sealing rollers in turn being equipped with a resilient plastics material ring. The running yarn, when passing the sealing devices, slightly deforms the resilient plastics material rings, which leads to a proper sealing function. The plastics material rings of the sealing rollers are, however, very wear-sensitive so the relatively short service life of plastics material rings of this type requires short maintenance intervals of the yarn treatment chambers. Short maintenance intervals, however, as a rule often have a very negative effect on the overall efficiency of the textile machines equipped with yarn treatment chambers of this type. A comparable yarn treatment chamber is described in German Patent Document DE 103 48 278 A1, in other words, a yarn treatment chamber, in which the thermal treatment section formed from a centre zone and two end zones also has a linear orientation and in which a respective sealing device acting as a yarn sluice is arranged at the end in the region of the yarn inlet or its yarn outlet opening. The yarn sluice is, in this case, equipped with wear-resistant yarn guide elements. In other words, the yarn sluice either has two identical yarn guide elements, which are, in each case, configured in a semi-circular manner and which are pressed against one another by a spring element and, in the region of a common centre longitudinal axis, have recesses forming a yarn guide channel, or the yarn guide elements of the yarn sluice are configured such that one of the yarn guide elements is rotatably mounted in the manner of a revolver magazine and has a plurality of yarn guide channel recesses of different sizes.

The yarn sluices of the yarn treatment chambers known from German Patent Document DE 103 48 278 A1 are very wear-resistant, but yarn sluices of this type are problematical because of the often somewhat difficult adaptation of the cross section of their yarn guide channel to the respective thickness of the yarn.

A yarn treatment chamber for the thermal treatment of a running yarn is also described in the subsequently published German Patent Document DE 10 2010 022 211, in which the thermal treatment section has a linear orientation and, accordingly, the yarn inlet opening or the associated yarn sluice is arranged really high and is difficult to access for the operating staff. A respective yarn sluice, the yarn guide elements of which form a yarn guide channel, which is sealed by the running yarn in the operating state, is also arranged in this yarn treatment chamber in the region of the yarn inlet opening and the yarn outlet opening. For adaptation to the average thickness of the running yarn, at least one of the yarn guide elements of the yarn sluice can be positioned steplessly in various positions.

The yarn sluices also in each case have a sealing element, which rests on the yarn guide elements, extends along the yarn guide channel and reacts resiliently to defects in the running yarn. In other words, the sealing element of the yarn sluice, in conjunction with the associated yarn guide elements, ensures a proper seal of the yarn guide chamber relative to the atmosphere and therefore allows good thermal treatment of a running yarn in the yarn treatment chamber.

SUMMARY OF THE INVENTION

Proceeding from yarn treatment chambers of the type described above, the invention is based on the object of developing a yarn treatment chamber, which is designed as optimally as possible ergonomically, in other words, to provide a yarn treatment chamber, in which both the yarn inlet opening and the yarn outlet opening are accessible at all times, safely and without problems, for the operating staff.

This object is achieved according to the invention by a yarn treatment chamber for the thermal treatment of a running yarn, with a centre zone, in which a hot, gaseous or vaporous medium under pressure acts on the yarn, and end zones arranged on both sides of the centre zone, in which a cooling, gaseous medium is active, the end zones each having a yarn inlet opening or a yarn outlet opening with a yarn sluice, which, in the operating state in conjunction with the running yarn, seals the associated end zone and therefore the yarn treatment chamber. According to the present invention, the yarn inlet opening and the yarn outlet opening are arranged in such a way that the running yarn has to change its running direction, in that the yarn treatment chamber, for this purpose, has yarn deflection means to guide the yarn fed through the yarn inlet opening to the yarn outlet opening and in that both the first yarn sluice arranged in the region of the yarn inlet opening and the second yarn sluice arranged in the region of the yarn outlet opening are arranged in a manner accessible without problems to the operating staff at an ergonomically favourable height below the yarn deflection means of the yarn treatment chamber.

Advantageous features, configurations and advantages of the invention are described more fully hereinafter.

The configuration according to the invention, in which the yarn inlet opening and the yarn outlet opening are arranged in such a way that the running yarn has to change its running direction and the yarn treatment chamber is, for this purpose, equipped with yarn deflection means to guide the yarn fed through the yarn inlet opening, wherein both the first yarn sluice arranged in the region of the yarn inlet opening and the second yarn sluice arranged in the region of the yarn outlet opening are arranged to be accessible without problems for the operating staff, at an ergonomically favourable height below the yarn deflection means of the yarn treatment chamber, has the advantage, in particular, that the two yarn sluices of a yarn treatment chamber of this type can be arranged at a substantially lower installation height, so the yarn sluices of the yarn treatment chamber are accessible for the operating staff substantially with less danger and effort than the yarn sluices of the hitherto known yarn treatment chambers, which, because of their linearly running yarn treatment section, have a very high yarn inlet opening. The good accessibility both of the yarn sluices arranged in the yarn inlet opening and in the yarn outlet opening means that not only can faulty operations be minimised, but also machine stoppage times can be reduced which occur during the manual threading of a new yarn after a yarn break or during maintenance, for example during the periodic cleaning of lubrication deposits, which has a very positive noticeable effect, for example, with regard to the efficiency of the textile machine.

According to another aspect of the invention, it is provided in an advantageous embodiment that the yarn is deflected by more than 90° by the yarn deflection means. An adequately long yarn treatment chamber can be installed on a narrow space owing to a configuration of this type, both the yarn inlet opening and the yarn outlet opening being able to be positioned in an ergonomically favourable manner for the operating staff at the same time.

It is preferably provided according to another aspect of the invention that the first yarn sluice installed in the yarn inlet opening of the yarn treatment chamber and the second yarn sluice installed in the yarn outlet opening of the yarn treatment chamber are arranged in the region of the lower side of the yarn treatment chamber. An installation position of this type does not only ensure good accessibility of the two yarn sluices but also considerably facilitates the attending to the yarn treatment chamber required after an interruption of the twisting or cabling process.

According to another feature of the invention, the two yarn sluices are preferably arranged adjacently in the region of the lower side of the yarn treatment chamber and at an ergonomically favourable height. With a configuration of this type of the yarn treatment chamber, the parts of the yarn treatment chamber to be attended to by the operating staff, especially the yarn sluices, are arranged in a region, in which they are easily accessible at all times for the operating staff, even without additional aids. A configuration of this type consequently does not only ensure that the manual threading of a yarn into the yarn sluices is relatively easy and without effort, but also significantly increases the working safety at the workstations.

According to another aspect of the invention, it is furthermore provided that the centre longitudinal axis of the first yarn sluice arranged in the region of the yarn inlet opening runs parallel to the centre longitudinal axis of the second yarn sluice arranged in the region of the yarn outlet opening of the yarn treatment chamber, which also substantially facilitates the elimination of yarn breaks, for example.

The operating friendliness of the yarn treatment chamber is optimised as a whole by the above-described positioning of the yarn sluices, so a rapid and proper elimination of yarn breaks and/or disruptions becomes possible without problems. Moreover, in an arrangement of this type of the yarn sluices, the periodic cleaning of the yarn sluices from lubrication deposits also becomes substantially easier.

In a further feature of the invention, at least one thread guide tube is used as the yarn sluice, the inside width of which is in each case adapted to the diameter of the yarn to be processed. A reliable seal of the yarn treatment chamber from the environment can be realised relatively easily using thread guide tubes of this type in conjunction with the running yarn.

Thread guide tubes of this type, which preferably have a round cross section, are also safe with regard to faulty operations and relatively insensitive to soiling because of their good self-cleaning by the yarn running through. The friction losses occurring when the yarn runs through the thread guide tubes are also negligible. In other words, using yarn sluices in the form of thread guide tubes, a reliable seal of the yarn treatment chamber under excess pressure relative to the environment is always ensured during operation.

According to another aspect of the invention, it is provided in an advantageous embodiment that the respective thread guide tube can be fixed in a receiver of the yarn inlet opening or the yarn outlet opening in such a way that the thread guide tube, if necessary, for example for manual threading of a yarn after a thread break or in the course of a batch change, can easily be removed from the receiver and can be inserted into the receiver again without problems after a new yarn has been threaded in.

By a corresponding configuration of the thread guide tubes and/or the receiver, it is also to be easily ensured that the thread guide tubes are reliably held in the receivers during the working process.

Thread guide tubes are, as a whole, sealing devices, which ensure that the yarn treatment chamber is always reliably sealed relative to the environment during the thermal treatment of the yarn, regardless of the average thickness of the respective yarn.

In accordance with another feature of the invention, it is provided in an advantageous embodiment that a plurality of thread guide tubes are stored in a receiving element, in each case. The receiving element, in this case, preferably keeps ready various thread guide tubes, in other words, thread guide tubes, which differ with regard to their inside width. During a batch change, the operating staff can immediately react without problems to the new yarn and ensure a reliable seal of the yarn treatment chamber.

According to another aspect of the invention, the receiving element is preferably configured and arranged such that a first thread guide tube can be positioned in the region of the yarn inlet opening and a second thread guide tube can be positioned in the region of the yarn outlet opening of the yarn treatment chamber and can be fixed in a corresponding receiver of the yarn inlet opening or a corresponding receiver of the yarn outlet opening of the yarn treatment chamber. With a configuration of this type, the change times, in particular during a batch change, can be considerably reduced. Moreover, when a plurality of thread guide tubes with different inside widths are stored in a receiving element, as already described above, the required thread guide tubes are always available immediately for each batch.

Another embodiment is overall an economical configuration of the positioning of thread guide tubes in the region of the yarn inlet opening and the yarn outlet opening of a yarn treatment chamber.

Instead of a common receiving element for all the thread guide tubes of the yarn inlet and yarn outlet opening of the yarn treatment chamber, it is provided in an alternative embodiment that a first receiving element for thread guide tubes of the yarn inlet opening is arranged in the region of the yarn inlet opening and a second receiving element for the thread guide tubes of the yarn outlet opening is arranged in the region of the yarn outlet opening. By arranging two separate receiving elements, the number of thread guide tubes that can be kept ready in the receiving elements can be significantly increased and the variability of the yarn treatment chamber in relation to the processing of yarns with a different thickness can therefore be relatively easily increased.

The receiving elements may, in this case, have various embodiments. The receiving elements may, for example, be configured in the manner of a revolver magazine or may be configured as a linearly displaceable mounted series magazine. Which of these magazines is more advantageous during operation can only be assessed with difficulty. In other words, the type of magazine used should primarily emerge from the space conditions prevailing in the region of the workstations.

According to additional aspects of the invention, it is furthermore provided that the receiving element can be adjusted either manually or mechanically by means of a positioning drive.

The manual adjustment of the receiving element is a very economical solution here, but, with a manual adjustment of this type, the danger cannot be fully ruled out of a faulty adjustment occurring, in other words, the operator inadvertently positioning a thread guide tube in a receiver of the yarn inlet opening or the yarn outlet opening, said thread guide tube not precisely fitting the yarn to be processed.

The adjustment of the receiving element by means of a corresponding positioning drive is somewhat more complex, but has the advantage that with a corresponding configuration of the activation of the positioning drive, it can be ensured that the correct thread guide tube is always positioned in the relevant yarn inlet or yarn outlet opening.

In another feature of the invention, the positioning drive for the receiving element is preferably configured as a stepping motor. Steeping motors of this type, as is known, with regard to the exact adjustment of their angle of rotation and therefore the exact adjustment of the position of the receiving element, require only a relatively small control outlay. In other words, good reproducibility of the adjustment of the receiving element can be ensured relatively easily by means of a stepping motor.

BRIEF DESCRIPTION OF THE DRAWINGS

Further details of the invention will be described below with the aid of an embodiment shown in the figures. In the drawings.

DETAILED DESCRIPTION OF THE PREFERRED EMBODIMENTS

Figure 1:
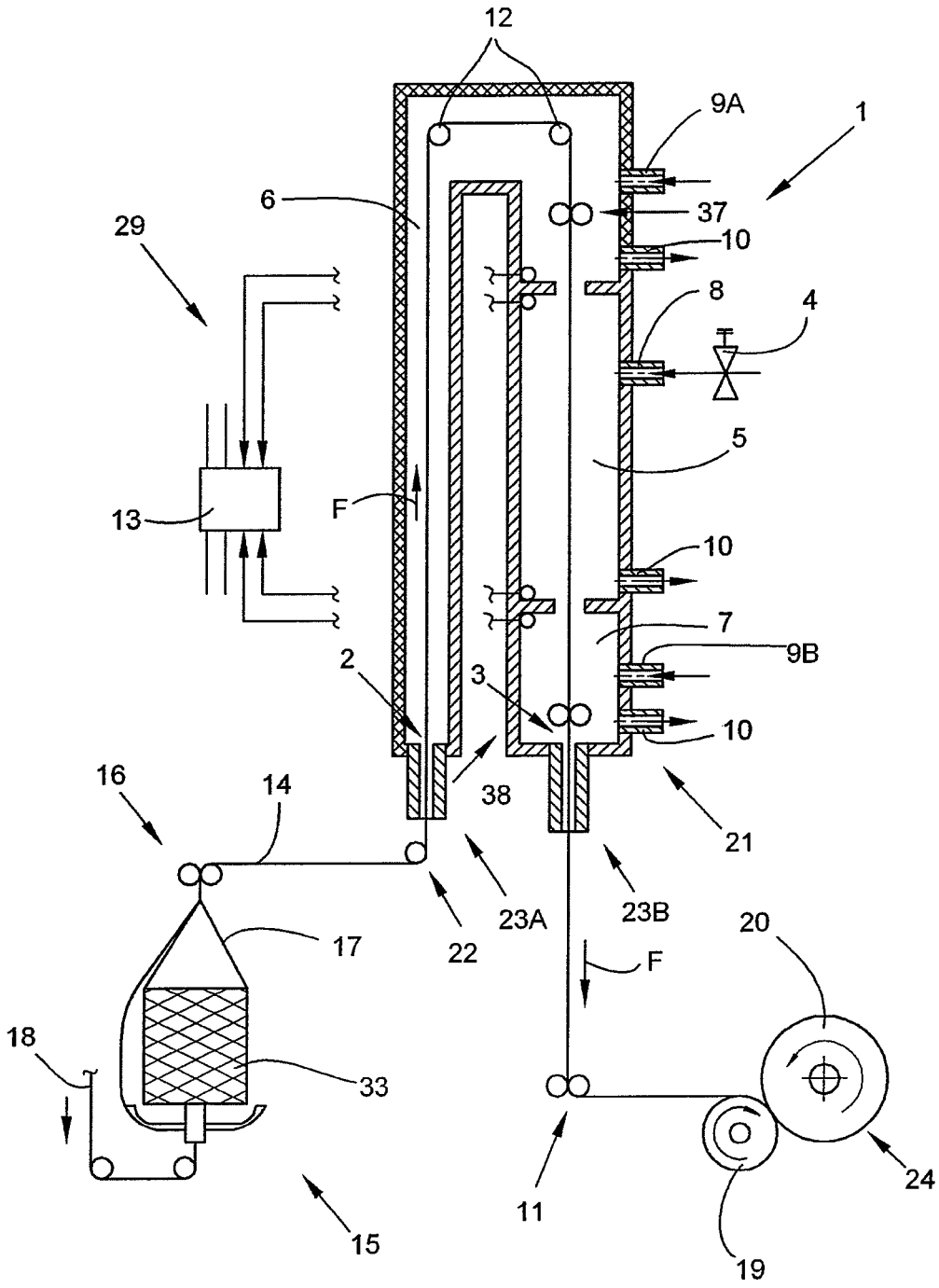
FIG. 1 shows a schematic diagram of a workstation of a twisting or cabling machine with a steam setting device, the yarn treatment chamber of which is configured according to the invention in such a way that the yarn inlet opening and the yarn outlet opening are arranged ergonomically favourably on one side of the yarn treatment chamber.

FIG. 1 sketches a schematic view of a workstation 29 of a twisting or cabling machine. Textile machines of this type generally have a large number of structurally similar workstations 29 of this type, arranged next to one another.

As shown in the present embodiment, each of the workstations 29 has a twisting or cabling device 15, a steam setting device 1 and a winding mechanism 24. In the embodiment, a thread 17 drawn off from a feed bobbin 33, which is arranged on a spindle of the twisting or cabling device 15, is firstly twisted by means of the twisting or cabling device 15 with a creel thread 18 to form a yarn 14. The yarn 14 then arrives via a draw-off mechanism 16 and via deflection means at the steam setting device 1, in which, as already indicated above, the yarn 14 is thermally treated. The steam setting mechanism 1, as known per se, has a yarn treatment chamber 21, the thread treatment section of which is divided into a centre zone 5 and a front end zone 6 and a rear end zone 7. The centre zone 5 is supplied here via a connection 8 with a hot, gaseous medium, preferably saturated steam or hot steam, while a cool gaseous medium, for example compressed air, is blown into the end zones 6 and 7, in each case, via connections 9A or 9B. The centre zone 5 and the end zones 6 and 7 also have, in each case, a discharge connection 10, by means of which steam or condensate can be discharged.

The yarn treatment chamber 21 furthermore has, in the region of the end zone 6 at the front in the yarn running direction F, a yarn inlet opening 2 and, in the region of the rear end zone 7, a yarn outlet opening 3. Moreover, the yarn treatment chamber 21 has yarn deflection means 12, which ensure that the yarn 14 introduced into the yarn treatment chamber 21 via the yarn inlet opening 2 is reliably deflected toward the yarn outlet opening 3.

Arranged in the region of the yarn inlet opening 2 or the yarn outlet opening 3 is, in each case, a yarn sluice 23A or 23B, which seals the yarn treatment chamber 21, which is under excess pressure, in conjunction with the running yarn 14 relative to the environment.

The yarn 14 thermally set in the steam treatment chamber 21 is guided via a draw-off device 11 to a winding mechanism 24 of the workstation 29 and wound there, for example, to form a cross-wound bobbin 20. The cross-wound bobbin 20 is preferably rotatably held in a pivotable creel (not shown) and rests with its surface on a winding roller 19, which rotates the cross-wound bobbin 20 with frictional engagement.

The hot, gaseous medium is fed to the yarn treatment chamber 21 of the steam setting device 1 via a steam line (not shown) of the twisting or cabling machine.

The steam feed can be metered here by a shut-off device 4 configured as a steam valve and may, if necessary, be interrupted.

Figure 1A:
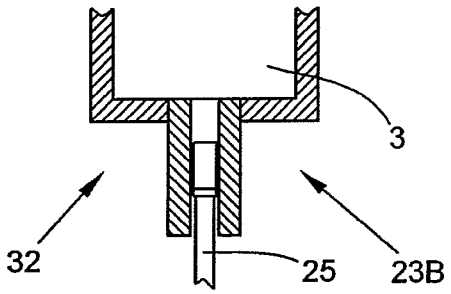
FIG. 1A shows one of the receivers arranged in the region of the yarn inlet opening and the yarn outlet opening to fix yarn sluices configured as thread guide tubes.

In order to make the yarn treatment chamber 1 as operator-friendly as possible, for example the front end zone of the yarn treatment chamber 21 in the yarn running direction F, as can easily be seen from FIG. 1, is configured in such a way that its yarn sluice 23A arranged in the region of the yarn inlet opening 2 is located adjacent to the yarn sluice 23B, which is arranged in the region of the yarn outlet opening 3 and seals the rear end zone 7 of the yarn treatment chamber 21. The yarn sluices 23A and 23B preferably arranged in parallel next to one another are positioned here at an operating height that is advantageous for the operating staff and, as described below, configured as thread guide tubes 25 in an advantageous embodiment. In other words, a receiver 32, in the central through-opening of which a thread guide tube 25 can, in each case, be fixed, is installed, in each case, in the region of the yarn inlet opening 2 or the yarn outlet opening 3 of the yarn treatment chamber 21, as shown in FIG. 1A. The inserted thread guide tube 25 is matched here with its inside width A, in each case, to the titre of the yarn to be processed, so that the yarn 14 that is running through forms a reliable yarn sluice 23A, 23B with the yarn guide tube 25.

As also shown in FIG. 1, the steam treatment chamber is equipped with a delivery mechanism 37 or a delivery mechanism 38 and deflection means 12. The delivery mechanisms 37 or 38 are used to supply the yarn 14 to be treated or to remove the treated yarn 14 from the centre zone and are correspondingly arranged in front of or behind the centre zone 5 in the end zones 6 or 7.

The two delivery mechanisms 37, 38 are used for the controlled transportation of the yarn 14 through the steam treatment chamber 21. In other words, the yarn 14 is held substantially constantly without tension while running through the steam treatment chamber 21 between the delivery mechanisms 37, 38.

The steam setting device mechanism 1 furthermore, as conventional and indicated only schematically in FIG. 1, has a sensor device, the sensors of which arranged in the steam treatment chamber 21 are connected by corresponding signal lines to an open- and closed-loop control device 13.

Moreover, the yarn treatment chamber 21, in the region of its yarn outlet opening 3, has an injector device (not shown), which can be acted on via a connection with compressed air and allows a pneumatic threading of the yarn 14 through the entire steam setting device 1, wherein, when thread guide tubes 25 are used as yarn sluices 23A and 23B, the latter firstly have to be removed before the threading of the yarn.

Figure 2A:
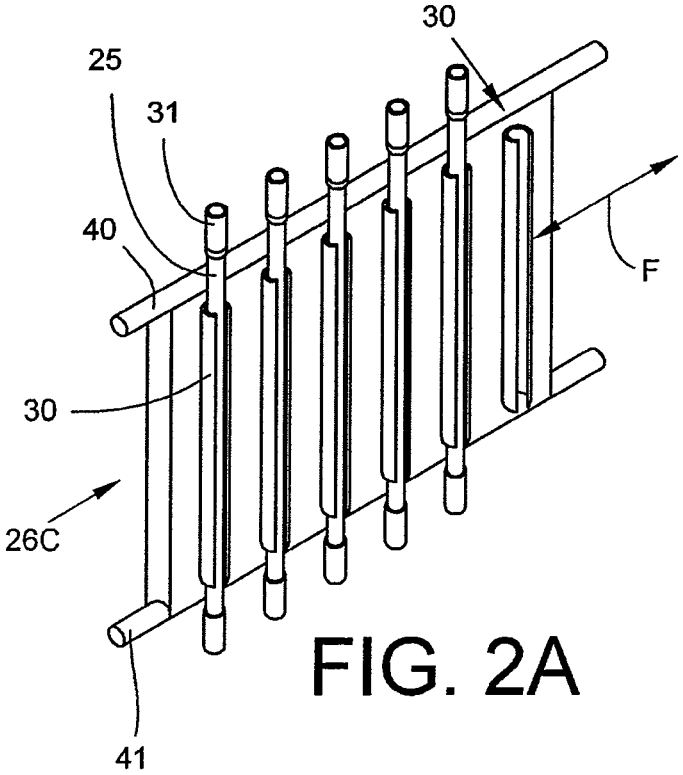
FIG. 2A shows, in a perspective view, a second embodiment of a receiving element, with some of the yarn sluices configured as thread guide tubes.
Figure 2:
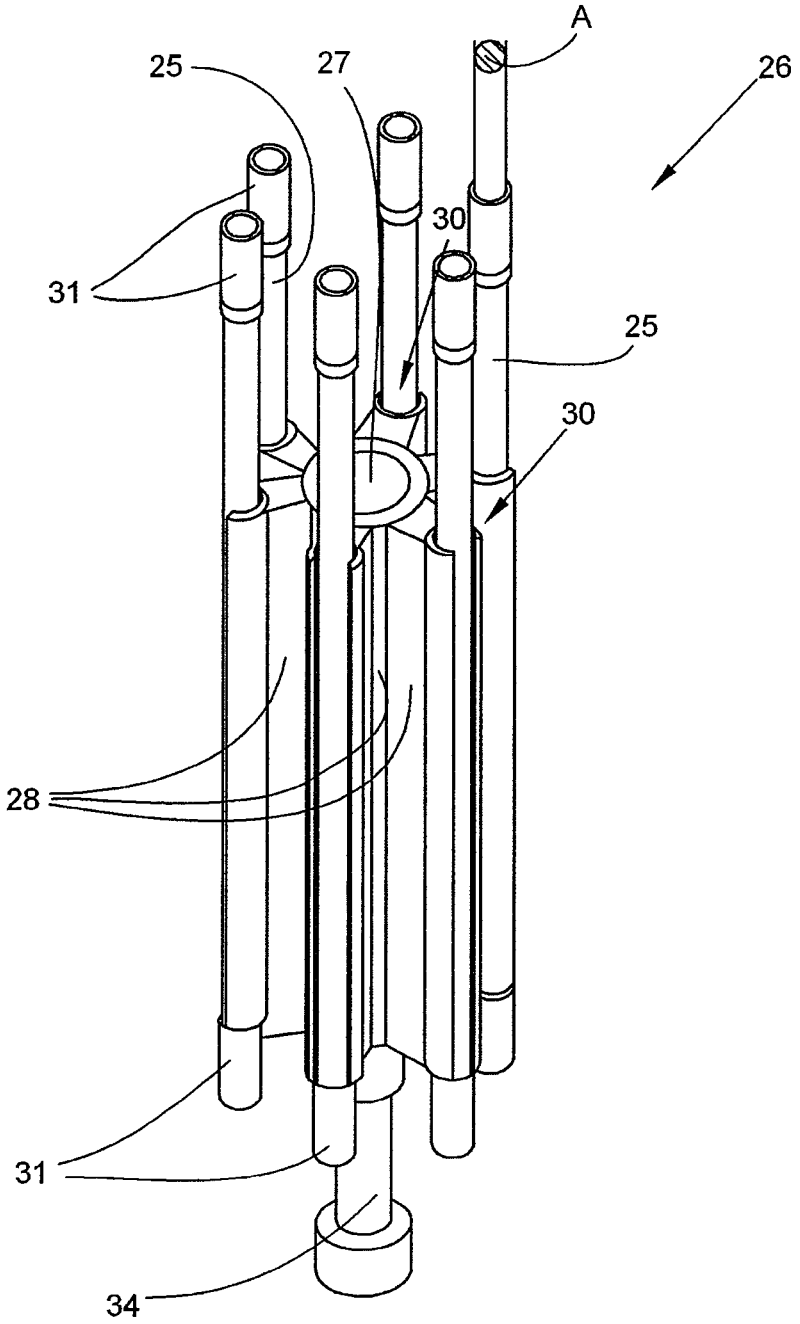
FIG. 2 shows, to a larger scale and in a perspective view, a first embodiment of a receiving element, with some of the yarn sluices configured as thread guide tubes.

FIG. 2 shows a perspective view of a first possible embodiment of a receiving element 26, which is used to keep six of the respective yarn sluices 23 ready, which are configured as thread guide tubes 25. The receiving element 26 manufactured, for example, from a plastics material, configured in the manner of a revolver magazine and shown in the present embodiment, preferably has a central bearing opening 27 as well as six radially arranged bearing webs 28, the bearing webs 28 each being equipped at the end with an outwardly open sliding guide body 30, in which the thread guide tubes 25 are mounted, axially displaceably and secured by attachment pieces 31.

The thread guide tubes 25 may have different inside widths A, two opposing thread guide tubes 25 in each case having the same inside width A in an advantageous embodiment. This means that two of the respective thread guide tubes 25 are matched to a specific yarn diameter D with regard to their inside width A and can simultaneously be positioned in the yarn inlet opening 2 or in the yarn outlet opening 3 of the yarn treatment chamber 21.

The attachment piece 31 is matched with regard to its dimension to a receiver 32 shown schematically in FIG. 5 and shown in section in FIG. 1A and arranged in the region of the yarn inlet opening 2 or the yarn outlet opening 3 of the yarn treatment chamber 21 in such a way that the thread guide tubes 25 can be installed in the receiver 32 without problems and removed again.

As already indicated above, the receiving element 26 shown in FIG. 2 is mounted in the installed state by a central opening 27 in the manner of a revolver magazine in an advantageous embodiment. In other words, the receiving element 26 is rotatably mounted on a bearing point 34 and, if necessary, can be manually or mechanically positioned in such a way that at least one of the thread guide tubes 25 mounted in the sliding guide bodies 30 can be inserted into the receiver 32 of the yarn inlet opening 2 and/or into the receiver 32 of the yarn outlet opening 3 of the yarn treatment chamber 21.

The receiving element arranged in the region of the yarn inlet opening and/or the yarn outlet opening may, however, also be configured as a linearly displaceably mounted series magazine 26C in a second embodiment.

A series magazine 26C of this type shown schematically in FIG. 2A has a base body displaceably mounted on linear guides 40, 41 with sliding guide bodies 30, in which the thread guide tubes 25 are mounted. The sliding guide bodies 30 can, in this case, be positioned below the receivers 32 of the yarn inlet and/or yarn outlet openings 2, 3 in such a way that the thread guide tubes 25 can be transferred without problems into the receivers 32.

Figure 3:
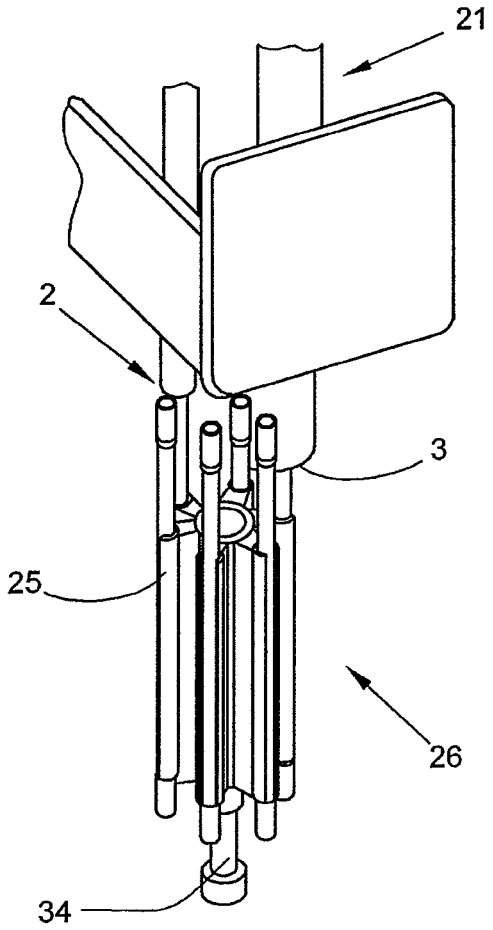
FIG. 3 shows a first embodiment of the arrangement of a receiving element for positioning thread guide tubes.
Figure 4:
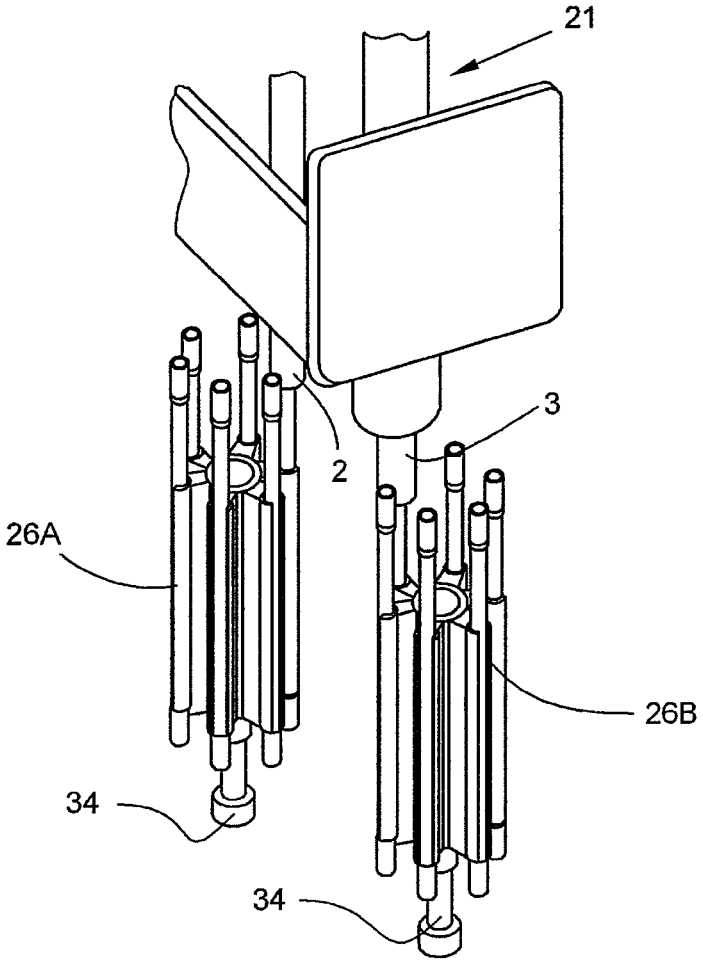
FIG. 4 shows a further embodiment of the arrangement of receiving elements for positioning thread guide tubes.

As shown in FIGS. 3 and 4, the receiving element 26 can either be arranged on the yarn treatment chamber 21 in such a way that, if necessary, both the receiver 32 of the yarn inlet opening 2 and the receiver 32 of the yarn outlet opening 3 of the yarn treatment chamber 21 can be supplied by means of the receiving element 26 with a thread guide tube 25 (FIG. 3) or there can be provision to arrange two separate receiving elements 26A and 26B (FIG. 4). In this case, a first receiving element 26A is positioned in the region of the receiver 32 of the yarn inlet opening 2 and a second receiving element 26B is arranged in the region of the receiver 32 of the yarn outlet opening 3. In this case, as well, the receiving elements 26A, 26B are equipped with a plurality of thread guide tubes 25, which, as described above, have different inside widths A.

As the two embodiments or arrangements of the receiving elements 26, 26A, 26B, 26C have advantages, it depends on the respectively existing operating conditions which of the two embodiments or arrangements is regarded as more advantageous.

The arrangement shown in FIG. 3 is, for example, more economical and the thread guide tubes 25 are very well accessible, in particular to thread the yarn, while the arrangement according to FIG. 4 has the advantage that more thread guide tubes 25 with different inside widths A can simultaneously be kept ready, which makes the device overall more flexible with regard to yarn batch changes.

FIGS. 5A to 5F schematically show the various method steps, which are necessary to again start up a yarn treatment chamber 21 according to the invention, the yarn sluices 23A and 23B of which in the embodiment are, in each case, formed by thread guide tubes 25, for example after a thread break.

Figure 5C:
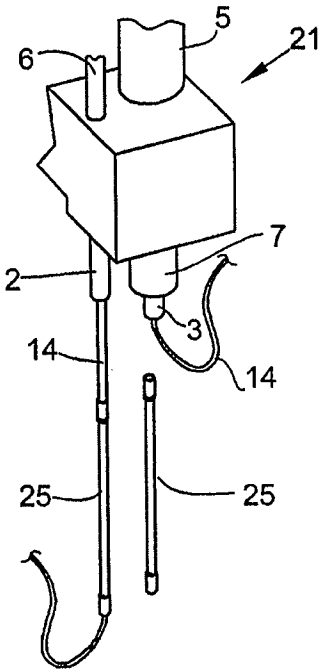
FIG. 5A-5F show, as an example, a possible work sequence of various working steps, which are necessary to thread a yarn into yarn sluices configured as thread guide tubes and arranged in the region of the yarn inlet opening and the yarn outlet opening of a yarn treatment chamber.
Figure 5B:
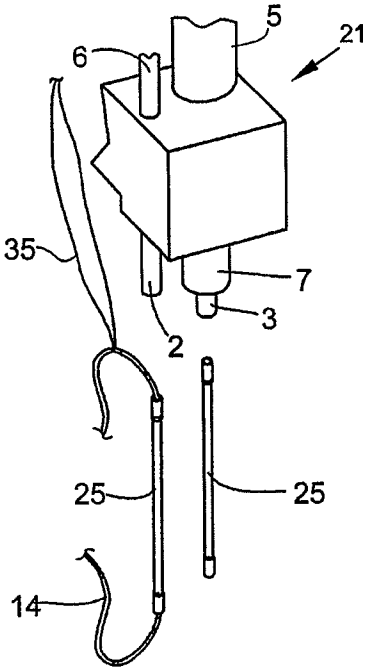
Figure 5A:
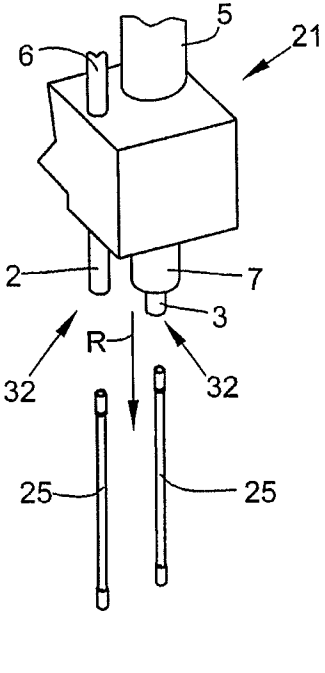

As can be seen from FIG. 5A, after a yarn break, the two thread guide tubes 25 being used as yarn sluices firstly have to be removed from the receivers 32 of the yarn inlet opening 2 and the yarn outlet opening 3 of the yarn treatment chamber 21. In other words, the two thread guide tubes 25 are loaded in the direction of the arrow R and in the process slide, in each case, from the receiver 32 of the yarn inlet opening 2 or from the receiver 32 of the yarn outlet opening 3 of the yarn treatment chamber 21.

In the next step, which is shown in FIG. 5B, the yarn 14 is drawn through one of the thread guide tubes 25 by means of a wire threader 35 and the yarn 14 is then "jetted" by means of an injector flow through the yarn treatment chamber 21, as shown in FIG. 5C.

Figure 5F:
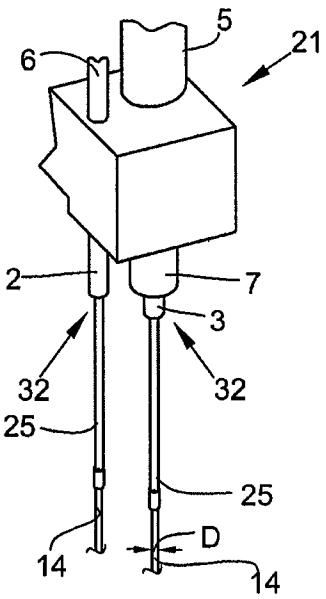
Figure 5E:
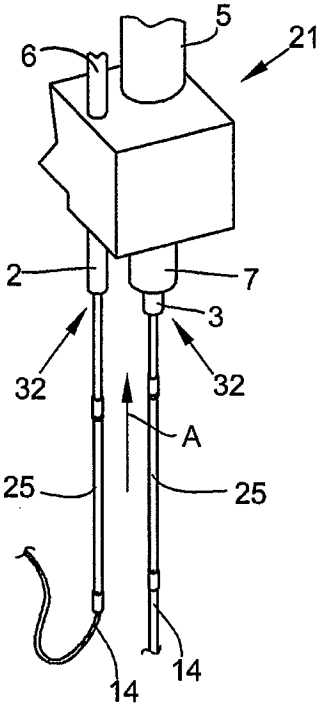
Figure 5D:
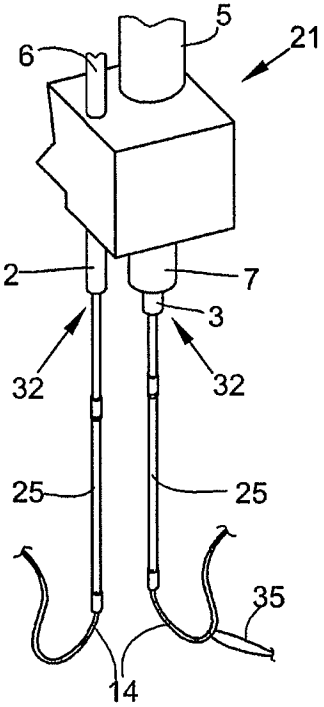

The yarn 14 leaving the yarn treatment chamber 21 is then, as shown in FIG. 5D, drawn by means of the wire threader 35 through the other thread guide tube 25, which, like the first thread guide tube 25, has an inside width A matched to the diameter D of the present yarn 14.

The two thread guide tubes 25 with the threaded-in yarn 14, as shown in FIG. 5E, are then inserted back into the receiver 32 of the yarn inlet opening 2 or into the receiver 32 of the yarn outlet opening 3 of the yarn treatment chamber 21.

If the two thread guide tubes 25, as shown in FIG. 5F, are properly fixed in their receivers 32, the yarn 14 can be guided via the draw-off device 11 to the winding mechanism and connected to the cross-wound bobbin 20. The workstation 29 is then ready for operation again.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Yarn treatment chamber for the thermal treatment of an individual running yarn, with a centre zone, in which a hot, gaseous or vaporous medium under pressure acts on the yarn, and end zones arranged on both sides of the centre zone, in which a cooling, gaseous medium is active, one end zone having a yarn inlet opening with a yarn sluice and the other end zone having a yarn outlet opening with a yarn sluice, the yarn inlet and outlet openings being adapted in the operating state in conjunction with the running yarn for sealing the associated end zone and therefore the yarn treatment chamber, characterized in that both yarn sluices (23A, 23B) are arranged below the yarn treatment chamber (21), and the yarn treatment chamber (21), has yarn deflection means (12) to guide the yarn (14) through a change of running direction while traveling from the yarn inlet opening (2) to the yarn outlet opening (3).

2. Yarn treatment chamber according to claim 1, characterized in that the yarn (14) is deflected by more than 90° by the yarn deflection means (12).

3. Yarn treatment chamber according to claim 1, characterized in that the yarn sluice (23A) installed in the yarn inlet opening (2) of the yarn treatment chamber (21) and the yarn sluice (23B) installed in the yarn outlet opening (3) of the yarn treatment chamber (21) are arranged in the region of a lower side of the yarn treatment chamber (21).

4. Yarn treatment chamber according to claim 1, characterized in that the two yarn sluices (23A, 23B) are arranged adjacently.

5. Yarn treatment chamber according to claim 1, characterized in that a centre longitudinal axis of the yarn sluice (23A) arranged in the region of the yarn inlet opening (2) of the yarn treatment chamber (21) runs parallel to a centre longitudinal axis of the yarn sluice (23B) arranged in the region of the yarn outlet opening (3) of the yarn treatment chamber (21).

6. Yarn treatment chamber according to claim 1, characterized in that each yarn sluice (23A, 23B) comprises at least one thread guide tube (25), the inside width (A) of which is matched to the diameter (D) of the yarn (14) to be processed.

7. Yarn treatment chamber according to claim 6, characterized in that the thread guide tube (25) has a round cross-section.

8. Yarn treatment chamber according to claim 6, characterized in that the thread guide tube (25) is fixed in a receiver (32) of the yarn inlet opening (2) or in a receiver (32) of the yarn outlet opening (3) of the yarn treatment chamber (21) in such a way that the thread guide tube (25), for the manual threading of a yarn (14), is removable from and reinsertable into the receiver (32).

9. Yarn treatment chamber according to claim 6, characterized in that a plurality of thread guide tubes (25) are stored in a receiving element (26, 26A, 26B, 26C).

10. Yarn treatment chamber according to claim 9, characterized in that the receiving element (26) is arranged and can be adjusted in such a way that a thread guide tube (25) can both be positioned in a receiver (32) of the yarn inlet opening (2) and also a further thread guide tube (25) can be positioned in a receiver (32) of the yarn outlet opening (3) of the yarn treatment chamber (21).

11. Yarn treatment chamber according to claim 9, characterized in that a first receiving element (26A, 26C) equipped with thread guide tubes (25) is arranged in the region of the yarn outlet opening (2) of the yarn treatment chamber (21) and a second receiving element (26B, 26C) equipped with thread guide tubes (25) is arranged in the region of the yarn inlet opening (3).

12. Yarn treatment chamber according to claim 9, characterized in that the receiving element (26, 26A, 26B) is configured in the manner of a revolver magazine.

13. Yarn treatment chamber according to claim 9, characterized in that the receiving element (26C) is configured as a linearly displaceably mounted series magazine.

14. Yarn treatment chamber according to claim 9, characterized in that the receiving element (26, 26A, 26B, 26C) can be adjusted manually.

* * * * *